US005651310A

United States Patent [19]

Kempen

[11] Patent Number: 5,651,310

[45] Date of Patent: Jul. 29, 1997

[54] DEVICE FOR APPLYING AN ADHESIVE COATING TO AN ENDLESS BELT IN A SCREEN PRINTING MACHINE

[75] Inventor: Henricus Gerardus Maria Kempen, Ledeacker, Netherlands

[73] Assignee: Stork Brabant B.V., Boxmeer, Netherlands

[21] Appl. No.: 416,438

[22] Filed: Apr. 3, 1995

Related U.S. Application Data

[63] Continuation of Ser. No. 50,829, Apr. 21, 1993, abandoned.

[30] Foreign Application Priority Data

Apr. 22, 1992 [NL] Netherlands ..... 9200728

[51] Int. Cl.[6] ..... B41F 15/24; B05C 3/18

[52] U.S. Cl. ..... 101/126; 118/410; 118/413; 118/419; 118/429

[58] Field of Search ..... 101/116, 117, 101/118, 126; 118/50, 410, 413, 419, 429, 602; 198/688.1

[56] References Cited

U.S. PATENT DOCUMENTS

| | | | |
|---|---|---|---|
| 3,025,828 | 3/1962 | Heilman | 118/419 |
| 3,420,167 | 1/1969 | Van Der Winden | 101/116 |
| 4,176,601 | 12/1979 | Szarka | 101/118 |
| 4,257,343 | 3/1981 | Kullander | 118/50 |
| 4,357,370 | 11/1982 | Alheid | 118/413 |
| 4,405,661 | 9/1983 | Alheid | 118/410 |
| 4,688,516 | 8/1987 | Sommer | 118/410 |
| 4,761,309 | 8/1988 | Embry | 118/410 |
| 4,934,310 | 6/1990 | Wöhrle et al. | 118/410 |
| 5,010,840 | 4/1991 | Busker et al. | 118/410 |

FOREIGN PATENT DOCUMENTS

| | | |
|---|---|---|
| 0011314 | 5/1980 | European Pat. Off. . |
| 7414939 | 5/1975 | Netherlands . |
| 8702413 | 5/1989 | Netherlands . |
| 628532 | 3/1982 | Switzerland . |

*Primary Examiner*—Stephen R. Funk
*Attorney, Agent, or Firm*—Deveau, Colton & Marquis

[57] ABSTRACT

A device for applying an adhesive coating to an endless belt in a screen printing machine, and having a trough, a pump for filling the trough to a level such that the meniscus of the adhesive contacts the belt, a doctor blade for removing excess adhesive and a pressure bellows for adjusting the pressure at which the doctor blade contacts the belt.

10 Claims, 2 Drawing Sheets

DEVICE FOR APPLYING AN ADHESIVE COATING TO AN ENDLESS BELT IN A SCREEN PRINTING MACHINE

This application is a continuation of Ser. No. 08/050,829 filed on Apr. 21, 1993 now abandoned.

BACKGROUND OF THE INVENTION

The present invention relates to a device for applying a coating of an adhesive substance to the downward facing external surface of an endless belt in a screen printing machine, at least comprising an elongated trough for holding a stock of an adhesive substance, means for bringing the adhesive substance into contact with said surface, and doctor means extending in the lengthwise direction of the trough, for setting a desired application of adhesive substance to said surface.

Such a device is known and is used for the application of an adhesive substance to an endless belt present in, for example, a screen printing device. The endless belt in such a screen printing device is used for guiding, for example, a textile web, while rotary screen printing stencils roll along the surface of the textile material lying on the belt, forming dye patterns in the process. In order to ensure that the textile material remains in the same position relative to the rotary silk screen stencils during the printing, which is particularly important if several colors have to be printed in succession in register, it is usual to fix the textile web relative to the moving endless belt by means of a temporary adhesive substance. The adhesive substance to be used, for example polyvinyl alcohol, is generally applied in the form of an aqueous solution to the underside of the belt not in contact with the stencils and the textiles to be printed. The textile web material to be stuck to the belt is brought into contact with the surface of the moving belt under light pressure and adheres in that way; at the end of the horizontal path leading below the screen printing stencils, the textile material is pulled away from the adhesive layer again. As the belt turns further, the adhesive layer, which has served its purpose, is generally removed from the belt by washing, after which a new, fresh adhesive layer is applied. In the known devices of the type indicated, the means for bringing the adhesive substance into contact with the surface of the endless belt are generally formed by a roller rotating in the trough, which roller is in contact with the downward facing surface of the endless belt; in that way the adhesive substance is applied to the surface of the belt from a stock in the trough; the doctor means, which are disposed downstream relative to the roller, viewed in the direction of movement of the belt, then set the thickness of the layer of adhesive substance.

Through the presence of the transfer roller(s) for the adhesive substance, such a known device has the disadvantage that it is heavy as a whole and is therefore difficult to handle, while a large space is also necessary for setting up the device.

SUMMARY OF THE INVENTION

The object of the present invention is then to provide a device of the type indicated, which can be made very light and which also takes up as little space as possible.

For this purpose, the invention provides a device of the type indicated, which is characterized in that the means for bringing the adhesive substance into contact with said surface comprise pumping means which can interact with a supply opening for the adhesive substance in the trough, for forming and maintaining a stock of adhesive substance in the trough.

It has been found that a device which is extremely good at application is obtained if the roller present in the known devices is dispensed with and replaced by pumping means which connect to the trough, and which can ensure such a level of adhesive substance in the trough that the surface of a stock thus placed in the trough comes into contact with the underside of the endless belt, and a desired application of adhesive substance to the surface of the endless belt is subsequently set by the doctor means also present here.

A considerable reduction in weight is achieved by dispensing with the transfer roller which is usual in the prior art, while such a device also takes up a very small amount of space.

In particular in the case of adhesive compounds which have a so-called convex meniscus, the pumping means can ensure such a quantity of adhesive substance that intermittent operation of pumping means will suffice, so that a new quantity of adhesive substance has to be fed in only if the level of the adhesive substance falls below a certain point.

Otherwise, it is also possible to select continuous operation of the pumping means which is such that the quantity supplied by the pumping means is essentially the same as the quantity of adhesive substance applied to the belt, and therefore disappearing from the trough. This then takes into account the fact that a part of the quantity applied to the belt is removed by the doctor means and flows back into the trough.

in a variant of the device, the pumping means are capable of continuous operation, and the trough comprises an overflow, so that the excess adhesive substance not taken up by the endless belt can run away through the overflow.

In order to obtain the lowest possible capacity of the trough, the overflow is advantageously made in the form of a partition, the surface of which is parallel to the surface of the doctor means present in the device.

A collection compartment expediently connects to the overflow, for receiving the adhesive substance flowing over the overflow.

The pumping means are preferably accommodated between a stock tank for the adhesive substance and the supply opening of the trough; if an overflow with a collection compartment is present in the device, it can be ensured that at least a part of the adhesive substance flowing into the collection compartment is returned to the stock tank. This permits a saving in adhesive substance, which is the maximum if all of the adhesive substance flowing into the collection compartment is returned.

The doctor means forming part of the device very advantageously interact with pressure setting means; these pressure setting means are preferably in the form of a pressure bellows, which at one side rests on a fixed surface and at the other side rests against a doctor blade forming part of the doctor means.

The invention also relates to a printing device for printing a web material such as textiles in register in several colors, using screen printing, said device comprising at least two printing positions, an endless belt, and a device for providing the endless belt with a coating of an adhesive substance, characterized in that the device for providing the endless belt with a coating of an adhesive substance is a device of the type described above.

BRIEF DESCRIPTION OF THE DRAWINGS

The invention will now be described with reference to the drawing, in which.

DESCRIPTION OF THE PREFERRED EMBODIMENTS

Figure 1:
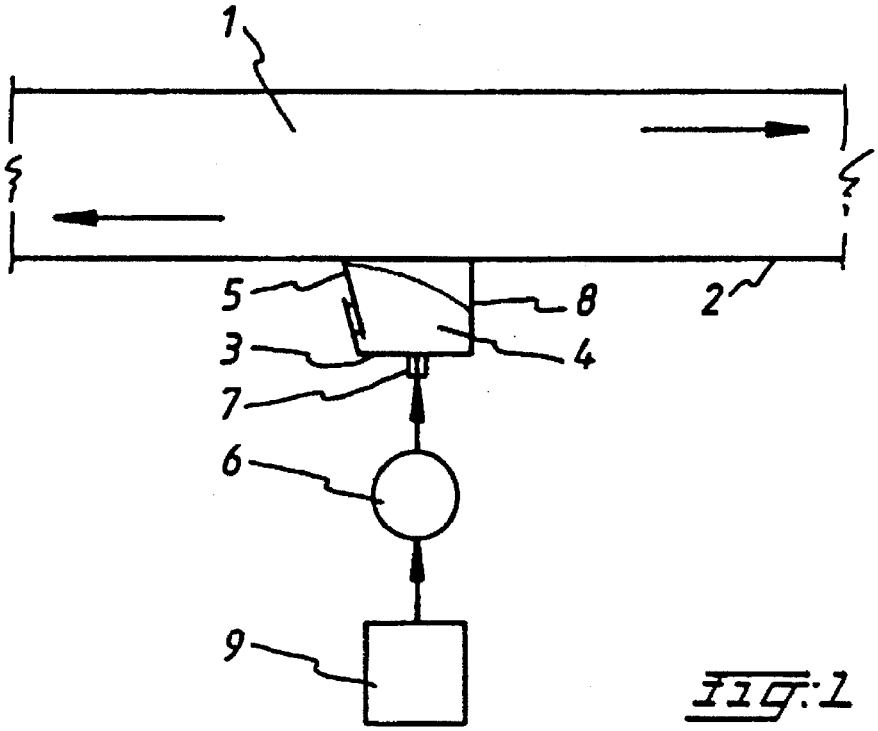
FIG. 1 shows diagrammatically a device and its layout, in a first embodiment.

FIG. 1 shows diagrammatically by 1 an endless belt which forms part of a textile printing device, such as a flat bed screen printing device or a rotary screen printing device.

The lower track of the endless belt is indicated by a trough of an application device for adhesive substance is indicated by 3, while a stock of the adhesive substance is indicated by 4. A doctor blade, which is fixed in a sealing manner to the trough 3, is indicated by 5. Pumping means 6 feed adhesive substance from a stock tank 9 to the supply opening 7 of the trough 3; a stock of adhesive substance 4 is formed. The trough 3 is bounded at the side lying opposite the doctor blade 5 by a partition 8, which can extend until it is close to the surface 2, or can even run against the surface 2. An essentially full trough 3 contains a stock of adhesive substance 4, the meniscus of which comes into contact with the surface 2 of the belt; the doctor 5 is set in such a way that a desired quantity of adhesive substance remains behind on the surface 2 of the belt 1.

The material of the trough 3 can be selected from: steel, stainless steel, (anodised) aluminium or plastic. Stainless steel or glassfibre-reinforced plastic such as polyester is preferably used.

Figure 2:
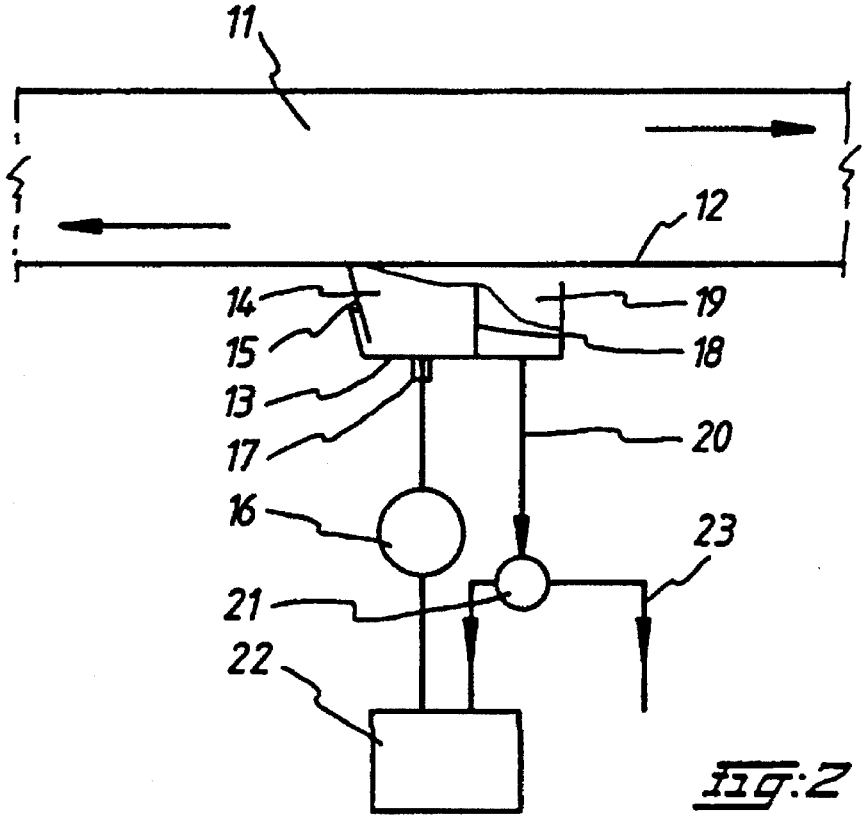
FIG. 2 shows the device of FIG. 1, provided with a collection compartment.

In FIG. 2 the endless belt is shown by 11, its surface by 12, the trough by 13, and the stock of adhesive substance by 14. The doctor means are indicated by 15; in this case the partition 18 lying opposite the doctor means 15 is in the form of an overflow. A stream of adhesive substance is pumped out of the stock tank 22 via the supply opening 17 into the trough 13 by means of the pumping means 16, in order to form a stock 14; the excess adhesive substance runs over the overflow 18 into the collection compartment 19.

This excess can be removed from the collection compartment through the line 20; the valve 21 makes it possible either to return this excess to the stock tank 22 or to remove it through line 23 and destroy it. The valve 21 also makes it possible to return a part of the excess to the stock tank 22 and to remove another part so that it can be destroyed.

Figure 3:
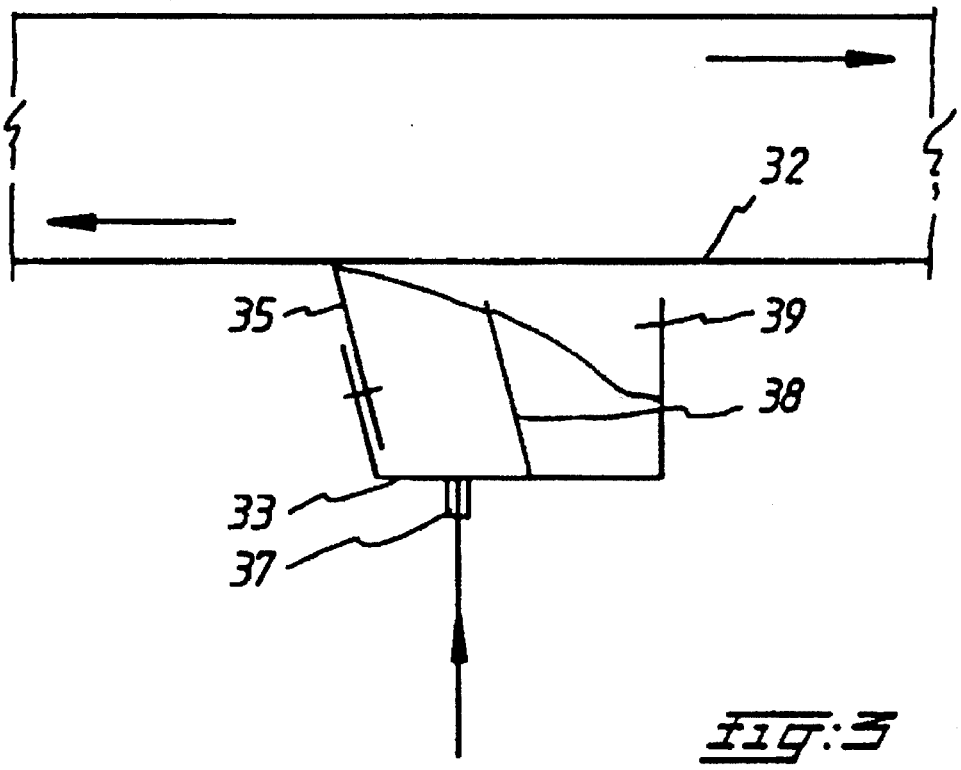
FIG. 3 shows a device according to FIG. 2, in which the overflow partition is parallel to the doctor blade accommodated in the doctor means of the device.

FIG. 3 shows a situation in which the trough is shaped advantageously, in order to make its volume as low as possible. The endless belt, the trough, the supply opening, and the collection compartment are indicted by numerals 32, 33, 37 and 39, respectively. It can be seen that the surface of the overflow 38, in the form of a partition, is parallel to the surface of the doctor blade 35, which forms part of the doctor means of the device.

Figure 4:
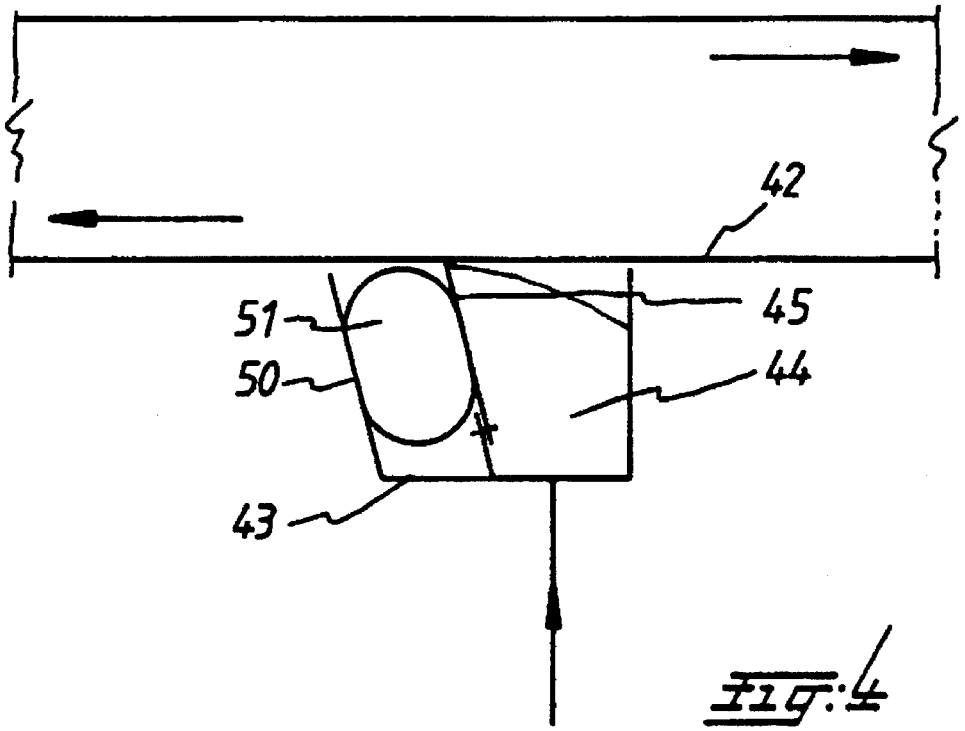
FIG. 4 shows a device of the type shown in FIG. 1, in which pressure setting means are present, for setting the pressure of the doctor blade.

Finally, FIG. 4 shows diagrammatically a device according to the invention and its arrangement relative to an endless belt, the doctor pressure being influenced by pressure setting means, which in this case are in the form of a pressure bellows 51. The pressure bellows 51 rest on a fixed surface 50 at one side and against the clamped doctor blade 45 at the other. The endless belt, the trough, and the stock of adhesive substance are indicted by numerals 42, 43 and 44, respectively.

The degree of compression of the doctor blade 45 can also be set as desired by varying the pressure inside the pressure bellows 51.

The trough forming part of the device according to the invention generally extends over the full width of the printing device in which it is being used; the device for applying a layer of adhesive substance to the belt of a printing machine can be removably mounted in the printing machine using means such as rails, which are not shown in any further detail. In general, it will be removed from the printing device by sliding along rails or another support in the lengthwise direction of the trough.

It can happen that the adhesive does not have to be applied over the full width of the endless belt. In that case the trough can be provided with slidable side sealing means, which can be in the form of a plastic part fitting accurately into the trough; such a plastic part can advantageously be made of polyurethane in solid or foamed form. Other plastics and metals are, of course, also permitted, provided that a good side seal is ensured in the trough and the material is not attacked by the adhesive substance used.

As regards the quantities of adhesive substance applied to the belt, it is pointed out that they can be, for example, of the order of 3 $g/m^2$ on the printing blanket (gram of the adhesive substance per square meter of the surface are of the belt). The printing blanket is approximately 3 meters wide; the printing speeds can be up to about 60 meters per minute in this case. In this way the device should be capable of applying quantities of around 0.5 kg adhesive per minute and more.

It is found that with the device according to the invention such a quantity can be applied very well and in a very reproducible and uniform manner.

While the invention has been disclosed in preferred forms, it will be apparent to those skilled in the art that many modification, additions, and deletions my be made therein without departing from the spirit and scope of the invention as set forth in the appended claims.

What is claimed is:

1. A device for applying a coating of an adhesive substance to a downward facing external surface of an endless belt moving in a direction of motion in a screen printing machine, the device comprising:

an elongated trough for holding a stock of the adhesive substance, said trough comprising a forward end and a rearward end, said forward end being displaced from said downward facing external surface of an endless belt moving in a direction of motion in a screen printing machine, the device comprising:

an elongated trough for holding a stock of the adhesive substance, said trough comprising a forward end and a rearward end, said forward end being displaced from said rearward end in the direction of motion of said belt, said rearward end of said trough further comprising a first partition having an upper edge, said trough being open to the atmosphere for applying the adhesive substance at atmospheric pressure;

means for bringing the adhesive substance into contact with the downward facing external surface, wherein said means for bringing the adhesive substance into contact with the downward facing external surface comprises pumping means connected to the trough for maintaining said stock of adhesive substance at a level in said trough, whereby a meniscus of said stock of adhesive substance extends above said upper edge of said first partition and thereby comes into contact with the downward facing external surface of said endless belt; and doctor means mounted adjacent said forward end of said trough and extending in a lengthwise direction of said trough for setting a desired application of the adhesive substance to the downward facing external surface.

2. A device according to claim 1, wherein said trough comprises an overflow element extending in the lengthwise direction of said trough.

3. A device according to claim 2, wherein said overflow element comprises a second partition having a surface which is parallel to a surface of said doctor means.

4. A device according to claim 3 further comprising a collection compartment connected to said overflow element for receiving adhesive substance flowing over said overflow element.

5. A device according to claim 2 further comprising a collection compartment connected to said overflow element for receiving adhesive substance flowing over the overflow element.

6. A device according to claim 5, further comprising a stock tank for storing adhesive substance, and wherein said pumping means is operatively connected with said stock tank to draw the adhesive sustance therefrom and supply it to said trough.

7. A device according to claim 6, further comprising means for returning adhesive substance from said collection compartment at least partially to said stock tank.

8. A device according to claim 1 further comprising pressure setting means for setting a pressure of said doctor means extending in the lengthwise direction of said trough against the downward facing external surface of the endless belt.

9. A device according to claim 8, wherein said doctor means comprises a doctor blade and said pressure setting means comprises a pressure bellows which at one side rests on a fixed surface and at the other side rests against said doctor blade.

10. In a printing device of the type for printing a web material such as textile in register in several colors, using screen printing, the printing device having at least two printing positions and an endless belt moving in a direction of motion, the improvement therein comprising a coating device for providing a downward facing external surface of the endless belt with a coating of an adhesive substance, wherein said coating device comprises:

an elongated trough for holding a stock of the adhesive substance, said trough comprising a forward end and a rearward end, said forward end being displaced from said rearward end in the direction of motion of said belt, said rearward end of said trough further comprising a first partition having an upper edge, said trough being open to the atmosphere for applying the adhesive substance at atmospheric pressure;

means for bringing a meniscus of the adhesive substance to a level about said upper edge of said partition and into contact with the endless belt and comprising pumping means connected to said trough for maintaining the stock of adhesive substance in said trough at said level; and doctor means mounted adjacent said forward end of said trough and extending in a lengthwise direction of said trough for limiting the application of the adhesive substance to a desired amount.

* * * * *